US008784096B2

(12) United States Patent
Mosiewicz

(10) Patent No.: US 8,784,096 B2
(45) Date of Patent: Jul. 22, 2014

(54) LOW NOX INDIRECT FIRE BURNER

(75) Inventor: Pawel Mosiewicz, Muncie, IN (US)

(73) Assignee: Honeywell International Inc., Morristown, NJ (US)

( * ) Notice: Subject to any disclaimer, the term of this patent is extended or adjusted under 35 U.S.C. 154(b) by 1331 days.

(21) Appl. No.: 12/569,189

(22) Filed: Sep. 29, 2009

(65) Prior Publication Data

US 2011/0076629 A1 Mar. 31, 2011

(51) Int. Cl.

| | |
|---|---|
| ***F23C 6/04*** | (2006.01) |
| ***F23C 5/00*** | (2006.01) |
| ***F23C 5/08*** | (2006.01) |
| ***F23D 14/10*** | (2006.01) |
| ***F24H 1/28*** | (2006.01) |

(52) U.S. Cl.

CPC ..... *F23C 6/047* (2013.01); *F23D 2203/1012* (2013.01); *F23C 5/08* (2013.01); *F23C 2201/401* (2013.01); *F23D 14/105* (2013.01); *F23C 2900/03005* (2013.01); *F24H 1/282* (2013.01)

USPC ..... 431/174; 431/352; 431/116; 60/39.37; 60/740

(58) Field of Classification Search

USPC ..... 431/350, 351, 352, 353, 174; 60/39.23, 60/39.37, 39.281, 39.511, 597, 740

See application file for complete search history.

(56) References Cited

U.S. PATENT DOCUMENTS

| | | | | |
|---|---|---|---|---|
| 2,869,626 | A * | 1/1959 | Sherman | 431/265 |
| 3,136,124 | A * | 6/1964 | Bertin et al. | 60/758 |
| 3,144,897 | A * | 8/1964 | Albert et al. | 431/114 |
| 3,220,401 | A * | 11/1965 | Jones et al. | 126/91 A |
| 3,225,757 | A * | 12/1965 | Keller | 126/91 R |
| 3,227,201 | A * | 1/1966 | Pokorny | 431/264 |
| 3,229,748 | A * | 1/1966 | Spielman | 431/352 |
| 3,254,695 | A * | 6/1966 | Brodlin | 431/328 |
| 3,384,442 | A * | 5/1968 | Stewart et al. | 431/264 |
| 3,620,657 | A * | 11/1971 | Robinson et al. | 431/9 |
| 4,519,770 | A * | 5/1985 | Kesselring et al. | 431/7 |
| 4,752,213 | A * | 6/1988 | Grochowski et al. | 431/328 |
| 5,350,293 | A | 9/1994 | Khinkis et al. | |
| 5,709,542 | A | 1/1998 | Rentzel et al. | |
| 6,663,380 | B2 | 12/2003 | Rabovitser et al. | |
| 6,672,859 | B1 | 1/2004 | Rabovitser et al. | |

(Continued)

FOREIGN PATENT DOCUMENTS

| | | |
|---|---|---|
| EP | 0 594 127 A1 | 10/1993 |
| EP | 0 717 239 A2 | 12/1995 |
| WO | 94/29647 A1 | 12/1994 |

OTHER PUBLICATIONS

Notification of Transmittal of the International Search Report and the Written Opinion from PCT/US2010/050471 dated May 18, 2011, 8 pages.

*Primary Examiner* — Steven B McAllister
*Assistant Examiner* — Desmond C Peyton
(74) *Attorney, Agent, or Firm* — Barnes & Thornburg LLP

(57) ABSTRACT

An air-fuel burner includes a heat-transfer tube, an air-fuel mixing chamber, and an air-fuel nozzle. The air-fuel nozzle is coupled to the air-fuel chamber to communicate a combustible air-fuel mixture into a combustion chamber defined between the air-fuel nozzle and the heat-transfer tube. The combustible air-fuel mixture, when ignited, establishes a flame in the combustion chamber to produce heat which is transferred through heat-transfer tube to an adjacent medium external to the heat-transfer tube.

21 Claims, 6 Drawing Sheets

(56) References Cited

U.S. PATENT DOCUMENTS 7,137,258 B2 * 11/2006 Widener ..... 60/776
8,561,430 B2 * 10/2013 Palmieri et al. ..... 65/134.5
2004/0013988 A1 * 1/2004 Kim ..... 431/2

* cited by examiner

LOW NOX INDIRECT FIRE BURNER

BACKGROUND

The present disclosure relates to burners and particularly to indirect fire burners. More particularly, the present disclosure relates to an indirect fire air-fuel burner configured to produce low $NO_x$ emissions.

SUMMARY

An air-fuel burner in accordance with the present disclosure comprises an air-fuel nozzle adapted to receive a combustible air-fuel mixture. The air-fuel nozzle is configured to discharge the combustible air-fuel mixture into a combustion chamber. The discharged combustible air-fuel mixture is ignited to produce a flame in the combustion chamber.

In illustrative embodiments, the air-fuel nozzle is configured to provide means for forming three nozzle exits to cause three separate flames to be established in the combustion chamber when the combustible air-fuel mixture is ignited. In an illustrative embodiment, the first nozzle exit is formed near an inner end of the elongated air-fuel nozzle, the third nozzle exit is formed at an opposite outer end of the elongated air-fuel nozzle, and the second (and largest) nozzle exit is formed near the opposite outer end and arranged to lie between the first and third nozzle exits. Each nozzle exit is defined by one or more nozzle apertures opening into an air-fuel transfer passageway formed in the air-fuel nozzle. The three nozzle exits are arranged in the air-fuel nozzle to cooperate to provide means for minimizing $NO_x$ formation within the flames while maximizing flame temperature and operating efficiency of the air-fuel burner.

In illustrative embodiments, the air-fuel burner comprises a heat-transfer tube, an air-fuel mixing chamber coupled to an upstream end of the heat-transfer tube, and the air-fuel nozzle. The air-fuel nozzle is coupled in fluid communication to the air-fuel mixing chamber and is arranged to extend into an interior region formed within the heat-transfer tube. The air-fuel nozzle lies in an interior region of the heat-transfer tube and cooperates with the heat-transfer tube to form the combustion chamber therebetween. The air-fuel mixing chamber mixes air and fuel to produce a combustible air-fuel mixture that is communicated in a downstream direction through the air-fuel nozzle and discharged from the air-fuel nozzle to feed a flame formed in the combustion chamber. The flame produces heat which heats the heat-transfer tube and is transferred from the heat-transfer tube to an adjacent medium outside the heat-transfer tube so that a temperature of the adjacent medium is raised.

In illustrative embodiments, about 10% to about 20% of the combustible air-fuel mixture flowing through the air-fuel transfer passageway moves into the combustion chamber through the first nozzle exit formed in the air-fuel nozzle. The first nozzle exit is configured to discharge a combustible air-fuel mixture that, when ignited, establishes a detached first flame extending in radially outward directions from the air-fuel nozzle toward the heat-transfer tube. The detached first flame includes a root that is detached from the air-fuel nozzle and a tip that is arranged to stabilize on an interior surface of the heat-transfer tube during combustion.

In illustrative embodiments, about 40% to about 80% of the combustible air-fuel mixture flowing through the air-fuel transfer passageway moves into the combustion chamber through a second nozzle exit formed in the air-fuel nozzle. The second nozzle exit is arranged to lie in spaced-apart relation to the first nozzle exit in the downstream direction.

The second nozzle exit is configured to discharge a combustible air-fuel mixture that, when ignited, establishes a detached second flame extending in radially outward directions from the air-fuel nozzle towards the heat-transfer tube. The detached second flame includes a root that is detached from the air-fuel nozzle and a tip that is arranged to stabilize on the interior surface of the heat-transfer tube.

In illustrative embodiments, about 10% to about 20% of the combustible air-fuel mixture flowing through the air-fuel transfer passageway moves into the combustion chamber through a third nozzle exit formed in the air-fuel nozzle. The third nozzle exit is arranged to locate the second nozzle exit between the first and third nozzle exits. The third nozzle exit is configured to discharge a combustible air-fuel mixture that, when ignited, establishes an attached third flame extending in the downstream direction away from the air-fuel nozzle and the detached first and second flames. The attached third flame includes a root that is stabilized on a free end of the air-fuel nozzle and a tip that extends freely in the downstream direction.

In illustrative embodiments, the air-fuel burner further includes spacer means for separating the second detached flame produced from the second nozzle exit and arranged to surround a circumference of the air-fuel nozzle into a series of circumferentially spaced-apart second flame portions. Each pair of adjacent second flame portions cooperate to define a combustion-products corridor therebetween to provide means for communicating combustion products of the detached first and second flames away from the air-fuel mixing chamber in the downstream direction through an upstream region in the combustion chamber inhabited by the detached second flame (without being burned in the detached second flame) and into a downstream region in the combustion chamber inhabited by the attached third flame (to be burned in the attached third flame).

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
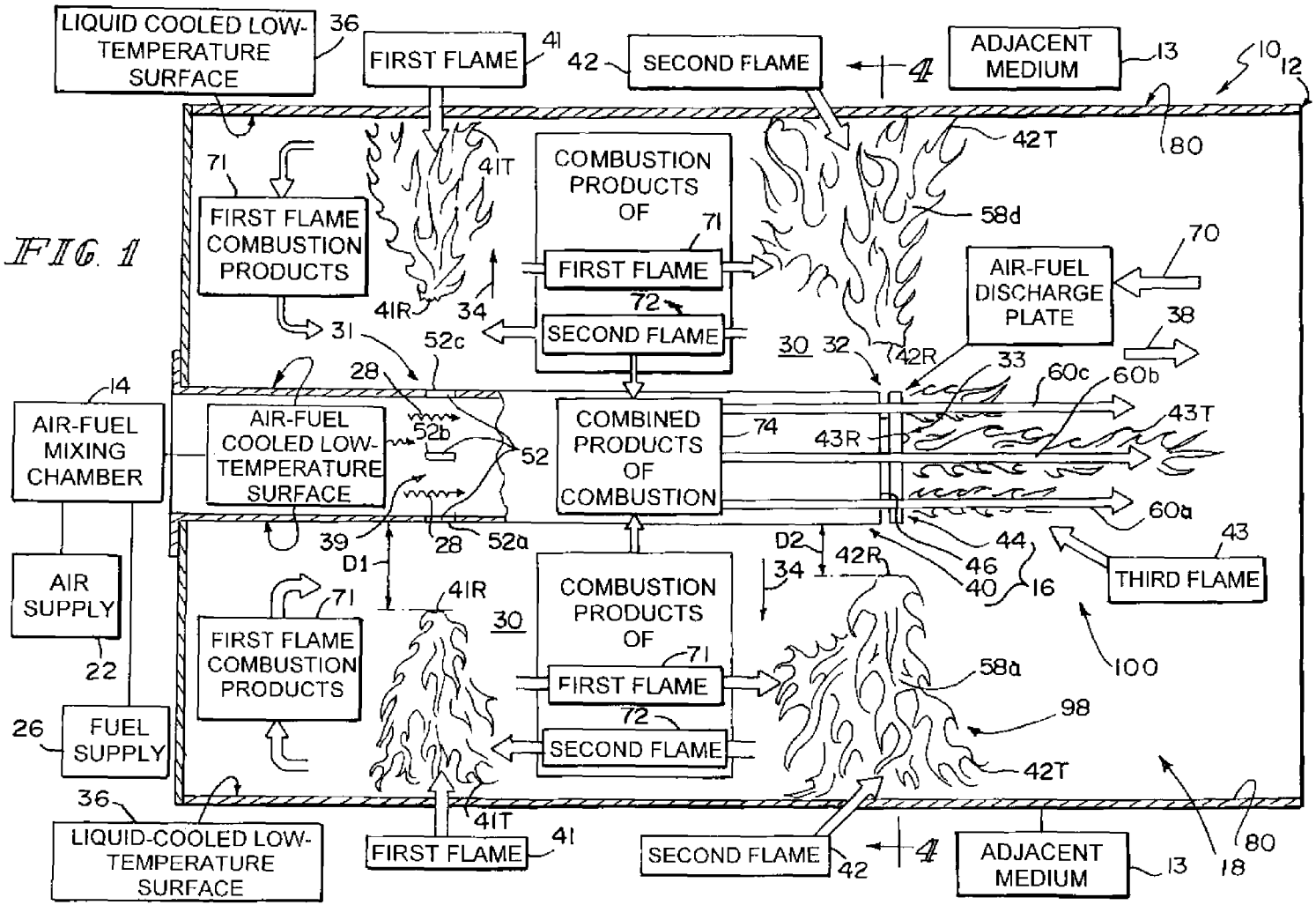
FIG. 1 is a diagrammatic view of an air-fuel burner in accordance with the present disclosure, showing that the air-fuel burner includes an air-fuel nozzle coupled to an air-fuel mixing chamber and is configured to discharge a combustible air-fuel mixture (1) through a first nozzle exit to establish a detached first flame extending in radially outward directions from the air-fuel nozzle that is stabilized on a liquid cooled low-temperature surface, (2) through a downstream second nozzle exit to establish a detached second flame extending in radially outward directions from the air-fuel nozzle that is stabilized on the liquid cooled low-temperature surface, and (3) through a further downstream third nozzle exit to establish an attached third flame attached to and stabilized on the air-fuel nozzle and extending in the downstream direction away from the air-fuel nozzle and suggesting that combustion products of the detached first and second flames are drawn into the detached first flame and that combustion products of the detached first flame are drawn into the detached second flame so that the formation of $NO_x$ is minimized during combustion, and that a portion of the combined products of combustion from the detached first and second flames that are not drawn into the detached first and second flames during combustion moves downstream through combustion-product corridors formed in the second flame and shown, for example, in FIG. 4 to reach and be burned in the attached third flame.
Figure 2:
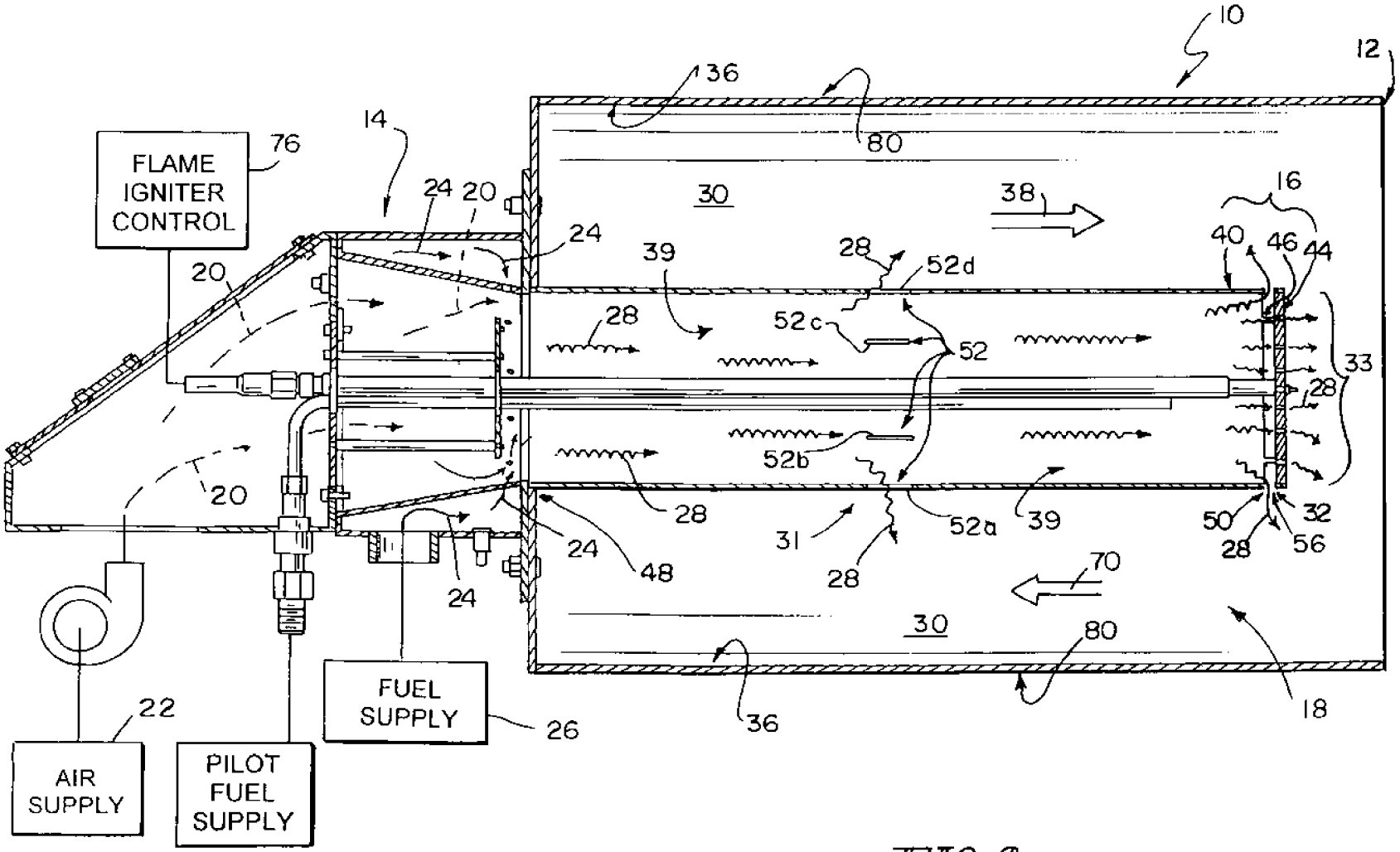
FIG. 2 is a side elevation view of an illustrative air-fuel burner in accordance with FIG. 1, with portions broken away, to reveal that the air-fuel burner includes an air-fuel nozzle arranged to lie within in a heat-transfer tube and that the air-fuel nozzle is coupled to an air-fuel mixing chamber wherein air from an air supply and fuel from a fuel supply are mixed together to establish a combustible air-fuel mixture which moves downstream through an air-fuel transfer passageway formed in the air-fuel nozzle and out of three nozzle exits formed in the air-fuel nozzle to establish, when ignited, the first, second, and third flames.

An illustrative air-fuel burner 10, in accordance with the present disclosure, includes a heat-transfer tube 12, an air-fuel mixing chamber 14, and an air-fuel nozzle 16 as shown in FIG. 1. Air-fuel nozzle 16 is coupled in fluid communication to air-fuel mixing chamber 14 and is arranged to extend into an interior region 18 of heat-transfer tube 12 as shown in FIG. 2. Air-fuel mixing chamber 14 mixes air 20 from an air supply 22 and fuel 24 from a fuel supply 26 to establish a combustible air-fuel mixture 28. Combustible air-fuel mixture 28 flows through air-fuel nozzle 16 into a combustion chamber 30 defined between heat-transfer tube 12 and air-fuel nozzle 16 and is ignited to form a flame. The flame generates heat that heats heat-transfer tube 12 so that heat is transferred from heat-transfer tube 12 to an adjacent medium 13 of any suitable kind as suggested in FIG. 1.

As shown in FIG. 1, air-fuel nozzle 16 provides means for forming a first nozzle exit 31, a second nozzle exit 32, and a third nozzle exit 33 that communicate combustible air-fuel mixture 28 from air-fuel transfer passageway 39 formed in air-fuel nozzle 16 into combustion chamber 30. First nozzle exit 31 is formed in air-fuel nozzle 16 and communicates combustible air-fuel mixture 28 to establish, when a portion of combustible air-fuel mixture 28 is ignited, a detached first flame 41 extending in radially outward directions 34 in combustion chamber 30 from air-fuel nozzle 16 toward heat-transfer tube 12. Detached first flame 41 is stabilized on an interior surface 36 of heat-transfer tube 12 in an illustrative embodiment as suggested in FIG. 1.

Second nozzle exit 32, as suggested in FIG. 1, is formed in air-fuel nozzle 16 and is arranged to lie in spaced-apart relation to first nozzle exit 31 in a downstream direction 38 away from air-fuel mixing chamber 14. Second nozzle exit 32 communicates combustible air-fuel mixture 28 into combustion chamber 30 to establish, when a portion of combustible air-fuel mixture 28 is ignited, a detached second flame 42 that extends in radially outward directions 34 from air-fuel nozzle 16 toward heat-transfer tube 12. Detached second flame 42 is stabilized on interior surface 36 of heat-transfer tube 12 is an illustrative embodiment as suggested in FIG. 1.

As shown in FIG. 1, third nozzle exit 33 is formed in air-fuel nozzle 16 and is arranged to lie in spaced-apart relation to second nozzle exit 32 in downstream direction 38 to locate second nozzle exit 32 between first and third nozzle exits 31, 33. Third nozzle exit 33 communicates combustible air-fuel mixture 28 into combustion chamber 30 to establish, when a portion of combustible air-fuel mixture 28 is ignited, an attached third flame 43 extending in downstream direction 38 way from air-fuel nozzle 16. Attached third flame 43 is stabilized on air-fuel nozzle 16, in an illustrative embodiment as suggested in FIG. 1.

Figure 3:
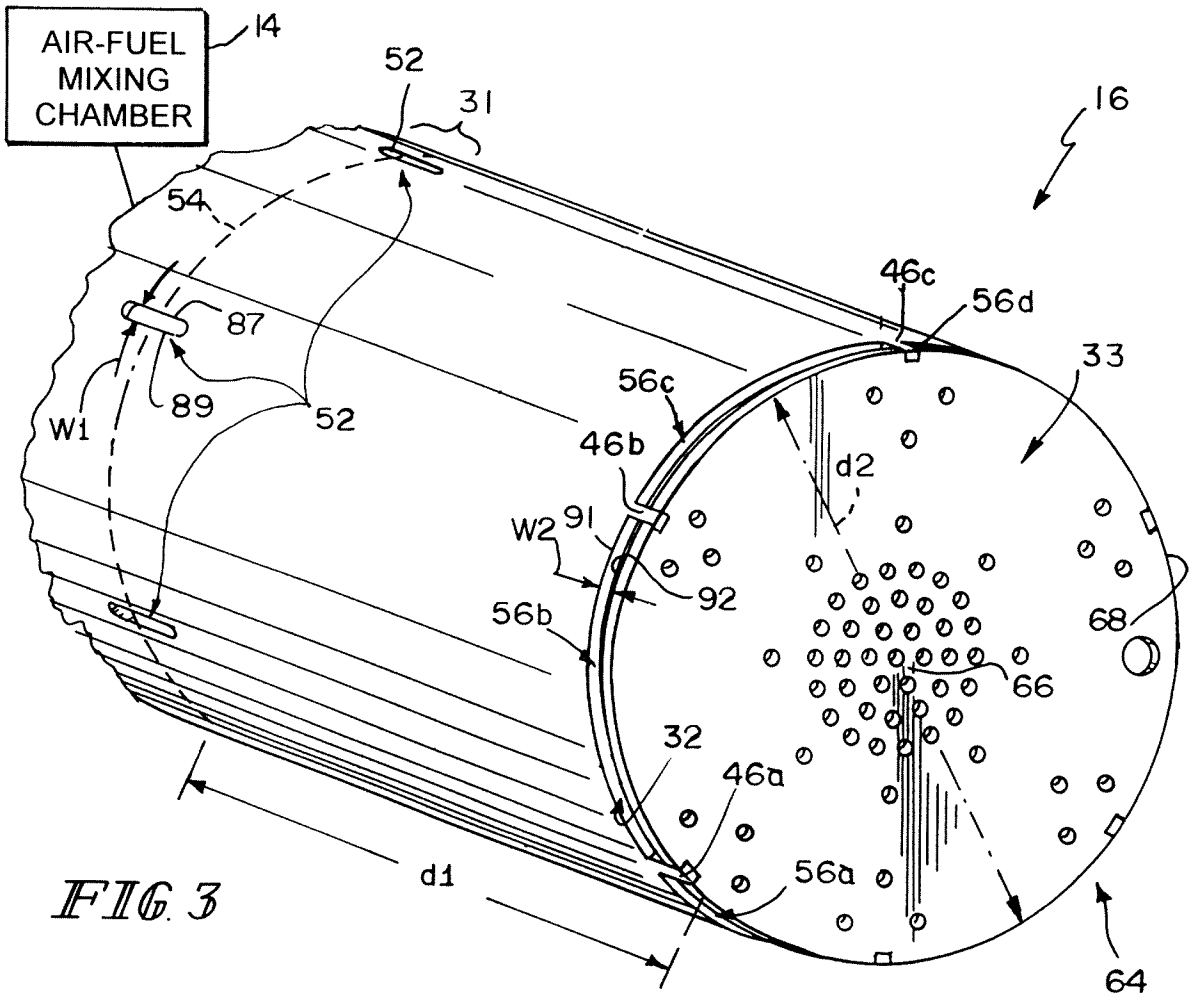
FIG. 3 is a partial perspective view of the air-fuel nozzle of FIGS. 1 and 2 showing that the air-fuel nozzle includes an air-fuel transfer conduit coupled to the air-fuel mixing chamber and that the air-fuel transfer conduit is formed to include a set of air-fuel discharge slots exposed to a combustible air-fuel mixture flowing in the air-fuel transfer passageway spaced-apart around the circumference of the air-fuel transfer conduit to establish the first nozzle exit associated with the detached first flame as shown in FIG. 1 and an air-fuel discharge plate coupled to a downstream end of the air-fuel transfer conduit to define a set of six air-fuel discharge ports exposed to a combustible air-fuel mixture flowing in the air-fuel transfer passageway spaced-apart around the circumference of the air-fuel transfer conduit to establish the second nozzle exit associated with the detached second flame as shown in FIG. 1 and showing that the air-fuel discharge plate is formed to include a set of staged air-fuel discharge apertures communicating with a combustible air-fuel mixture flowing in the air-fuel transfer passageway and opening in the downstream direction to establish the third nozzle exit associated with the attached third flame as shown in FIG. 1.

Illustratively, air-fuel nozzle 16 includes an air-fuel transfer conduit 40, an air-fuel discharge plate 44, and a set of discharge-plate spacers 46 as shown in FIG. 3. Air-fuel transfer conduit 40 is formed to include air-fuel transfer passageway 39 and is coupled in fluid communication to air-fuel mixing chamber 14 to receive an air-fuel mixture discharged from air-fuel mixing chamber 14. A set of discharge-plate spacers 46 are arranged to interconnect air-fuel transfer conduit 40 and air-fuel discharge plate 44.

As shown in FIG. 2, air-fuel transfer conduit 40 includes an upstream end 48 and a downstream end 50 arranged to lie in spaced-apart relation in downstream direction 38 opposite to upstream end 48. Air-fuel transfer conduit 40 is further formed to include an air-fuel transfer passageway 39 communicating combustible air-fuel mixture 28 from air-fuel mixing chamber 14 between upstream end 48 and downstream end 50 as shown in FIG. 2. Air-fuel transfer conduit 40 is coupled to air-fuel mixing chamber 14 at upstream end 48. Set of discharge-plate spacers 46 interconnect downstream end 50 of air-fuel transfer conduit 40 to air-fuel discharge plate 44.

As shown in FIGS. 2 and 3, first nozzle exit 31 and second nozzle exit 32 are formed in air-fuel transfer conduit 40. Illustratively, first nozzle exit 31 is arranged to lie in spaced-apart relation to air-fuel mixing chamber 14 in downstream direction 38. Second nozzle exit 32 is arranged to lie in spaced-apart relation to first nozzle exit 31 in downstream direction 38 at downstream end 50 of air-fuel transfer conduit 40.

First nozzle exit 31 is defined by a series of air-fuel discharge slots 52 arranged to lie in spaced-apart relation to one another around a circumference 54 of air-fuel transfer conduit 40 as shown in FIG. 3. Illustratively, series of air-fuel discharge slots 52 is defined by first, second, third, fourth, fifth, and sixth air-fuel discharge slots 52*a*, 52*b*, 52*c*, 52*d*, 52*e*, and 52*f* that are positioned to lie in generally equally spaced-apart relation to one another.

Second nozzle exit 32 illustratively is defined by a series of air-fuel discharge ports 56 arranged to lie in circumferentially spaced-apart relation to one another around circumference 54 of air-fuel transfer conduit 40 as shown in FIG. 3. Illustratively, series of air-fuel discharge ports 56 is defined by first, second, third, fourth, fifth, and sixth air-fuel discharge ports 56*a*, 56*b*, 56*c*, 56*d*, 56*e*, and 56*f* that are positioned to lie generally equally spaced-apart to one another. Each air-fuel discharge port 56*a*, 56*b*, 56*c*, 56*d*, 56*e*, and 56*f* is defined by downstream end 50 of air-fuel transfer conduit 40, air-fuel discharge plate 44, and set of discharge-plate spacers 46.

Figure 5:
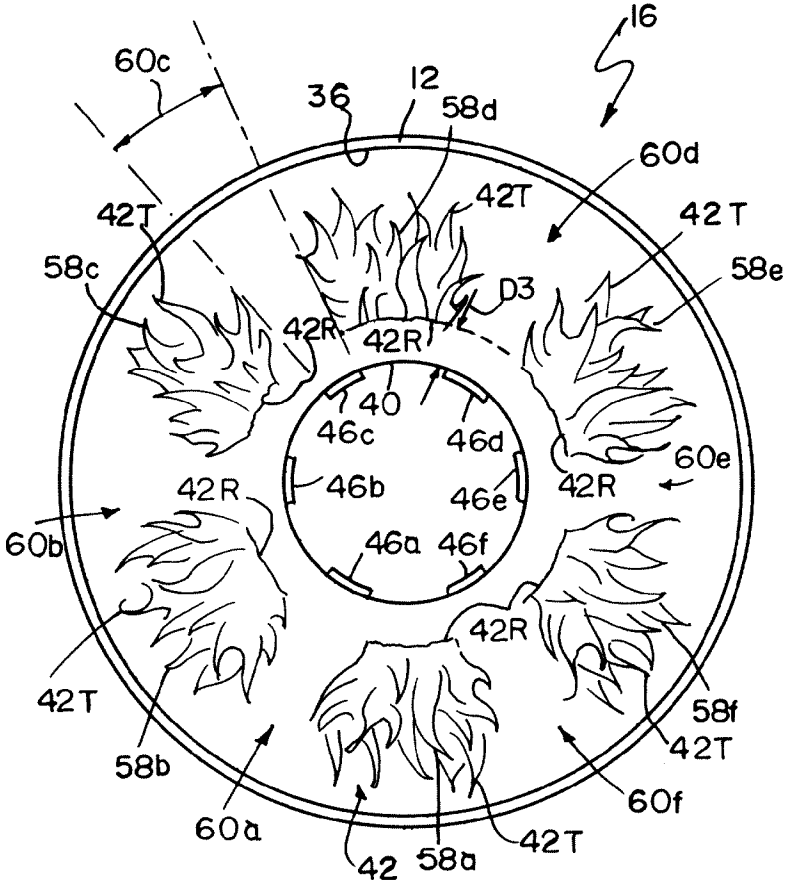
FIG. 5 is view similar to FIG. 4 taken along line 4-4 showing the detached second flame when the air-fuel burner is in a low-fire state.
Figure 4:
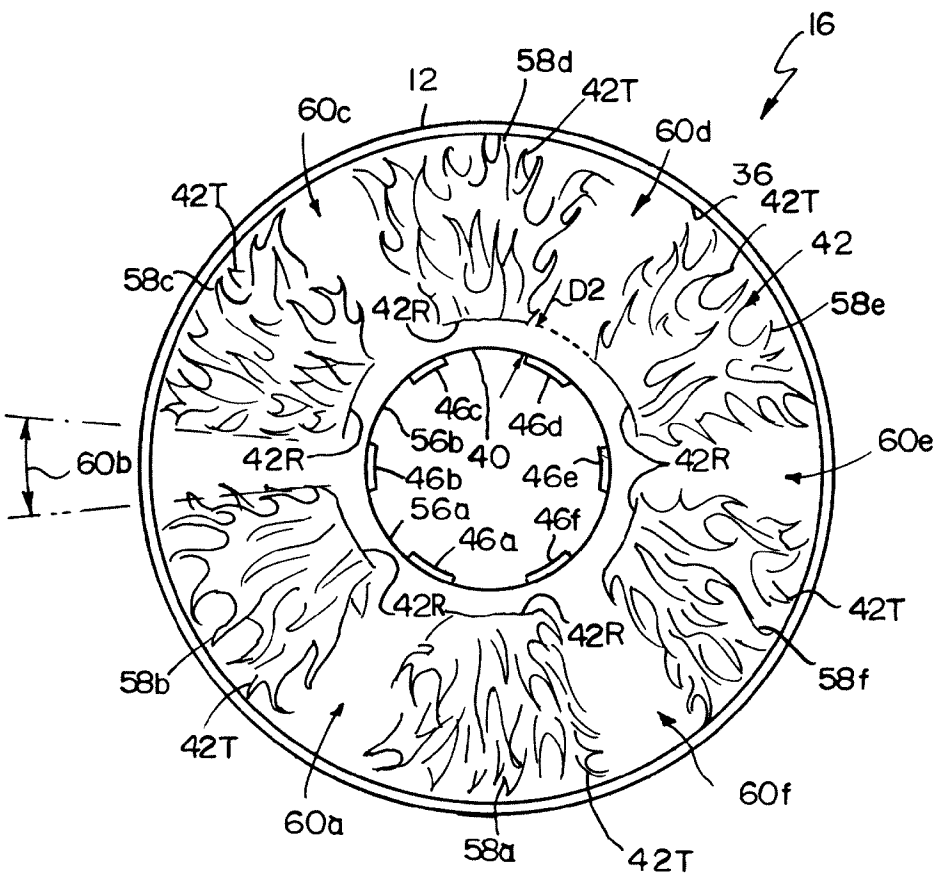
FIG. 4 is a sectional view of the air-fuel nozzle taken along line 4-4 of FIG. 1 showing that the air-fuel burner is in a high-fire state, the a root of detached second flame is spaced-apart from the air-fuel nozzle and a tip of detached second flame is stabilized on the liquid cooled low-temperature surface, and showing that the second flame comprises six second-flame portions and each second-flame portion is associated with one of the air-fuel discharge ports defining the second nozzle exit.

As shown in FIG. 3, set of discharge-plate spacers 46 include, for example, first, second, third, fourth, fifth, and sixth discharge-plate spacers 46*a*, 46*b*, 46*c*, 46*d*, 46*e*, and 46*f* that are positioned to lie in generally equally spaced-apart to one another. Set of discharge-plate spacers 46 cooperate to provide spacer means for separating detached second flame 42 produced from second nozzle exit 32 to produce a series of circumferentially spaced-apart second flame portions 58 as illustrated in FIGS. 4 and 5. Series of second flame portions 58 illustratively includes six second flame portions 58*a*, 58*b*, 58*c*, 58*d*, 58*e*, and 58*f* and each pair of second flame portions cooperate to define therebetween a combustion-products corridor 60 configured to provide means for communicating combined combustion products 74 of detached first and second flames 41, 42 away from air-fuel mixing chamber 14 in downstream direction 38 through an upstream region 98 in combustion chamber 30 inhabited by detached second flame 42 without being burned in second flame 42 and into a downstream region 100 in combustion chamber 30 inhabited by attached third flame 43 to reach and be burned in third flame 43 as suggested in FIG. 1. As an example, the pair of second flame portions 58*a*, 58*b* cooperate to define combustion-product corridor 60*a* therebetween as shown in FIGS. 4 and 5.

Six combustion-product corridors 60*a*, 60*b*, 60*c*, 60*d*, 60*e*, and 60*f* are formed between second flame portions 58*a*, 58*b*, 58*c*, 58*d*, 58*e*, and 58*f* as shown in FIGS. 4 and 5. It is within the scope of this disclosure to form any suitable number of combustion-products corridors in second flame 42. Combustion-product corridors 60*a*, 60*b*, 60*c*, 60*d*, 60*e*, and 60*f* communicate combined combustion products 74 from detached first and second flames 41, 42 in downstream direction 38 as suggested in FIG. 1 and shown in FIGS. 4 and 5. Combustible air-fuel mixture 28 moves downstream through air-fuel transfer passageway 39 formed in air-fuel transfer conduit 40 and is turned in radially outward directions 34 by air-fuel discharge plate 44. Combustible air-fuel mixture 28 moves around each discharge-plate spacer 46*a*, 46*b*, 46*c*, 46*d*, 46*e*, and 46*f* through air-fuel discharge ports 56*a*, 56*b*, 56*c*, 56*d*, 56*e*, and 56*f* to establish the generally and illustratively V-shaped combustion-product corridors 60*a*, 60*b*, 60*c*, 60*d*, 60*e*, and 60*f* shown, for example, in FIGS. 4 and 5.

Third nozzle exit 33, as shown in FIG. 3, is formed in air-fuel discharge plate 44. Third nozzle exit 33 is defined by an illustrative series of staged air-fuel discharge apertures 64 arranged to extend in a pattern to lie between a center 66 and a perimeter edge 68 of air-fuel discharge plate 44 as shown in FIG. 3. Other patterns of staged air-fuel discharge apertures are possible and contemplated within the scope of the present disclosure. Attached third flame 43, when a portion of combustible air-fuel mixture 28 is ignited, extends between center 66 and perimeter edge 68 to initiate and maintain ignition of detached second flame 42.

In one embodiment of the present disclosure, first nozzle exit 31 is configured to communicate about 10% to about 20% of combustible air-fuel mixture 28 by volume into combustion chamber 30. Second nozzle exit 32 is configured to communicate about 40% to about 80% of combustible air-fuel mixture 28 by volume into combustion chamber 30. Third nozzle exit 33 is configured to communicate about 10% to about 20% of combustible air-fuel mixture 28 by volume in downstream direction 38.

As suggested in FIG. 1, about 10% to about 20% of combustible air-fuel mixture 28 by volume exits through first nozzle exit 31 to establish detached first flame 41. As detached first flame 41 combusts, detached first flame 41 forms first flame combustion products 71. A portion of first flame combustion products 71 moves in an upstream direction 70 opposite to downstream direction 38 toward air-fuel mixing chamber 14 and first flame combustion products 71 are drawn into combustible air-fuel mixture 28 exiting first nozzle exit 31. First flame combustion products 71 mix with combustible air-fuel mixture 28 exiting first nozzle exit 31 and operate as an inert component during combustion to minimize thermal nitrous oxide ($NO_x$) formation in detached first flame 41. Another portion of first flame combustion products 71 moves in downstream direction 38 to mix with combustible air-fuel mixture 28 exiting second nozzle exit 32.

Second nozzle exit 32 communicates about 40% to about 80% of combustible air-fuel mixture 28 to combustion chamber 30. As detached second flame 42 combusts, detached second flame 42 forms second flame combustion products 72. A first portion of second flame combustion products 72 moves in downstream direction 38. Another portion of second flame combustion products 72 moves in upstream direction 70 toward detached first flame 41 and is drawn into combustible air-fuel mixture 28 exiting first nozzle exit 31 to minimize $NO_x$ formation in detached first flame 41. Similarly, a portion of first flame and second flame combustion products 71, 72 are mixed with combustible air-fuel mixture 28 exiting second nozzle exit 32 and operate as inert components during combustion of detached second flame 42 to minimize $NO_x$ formation in detached second flame 42.

As suggested in FIG. 1, combined combustion products 74 of detached first and second flames 41, 42 move in downstream direction 38 through series of combustion-products corridors 60 formed in detached second flame 42 without being burned in detached second flame 42. Third flame 43 operates to burn any unburned hydrocarbons in combined combustion products 74 and to minimize carbon monoxide (CO) formed by detached first and second flames 41, 42.

Illustratively, detached first flame 41 includes a root 41R and a tip 41T as shown in FIG. 1. Root 41R is positioned to lie between air-fuel transfer conduit 40 and heat-transfer tube 12. Tip 41T is positioned to lie between root 41R and heat-transfer tube 12. As an example, root 41R is spaced-apart from air-fuel transfer conduit 40 a first distance D1 as shown in FIG. 1. First distance D1 allows detached first and second flame combustion products 71, 72 to be mixed into combustible air-fuel mixture 28 exiting first nozzle exit 31 prior to ignition of detached first flame 41. Tip 41T of detached first flame 41 maintains combustion by extending out and stabilizing on interior surface 36 of heat-transfer tube 12. As a result of root 41R being spaced-apart from first nozzle exit 31, the temperature of air-fuel transfer conduit 40 around first nozzle exit 31 is minimized further minimizing $NO_x$ formation from detached first flame 41.

Second detached flame 42 includes a root 42R and a tip 42T as shown in FIG. 1. Root 42R is positioned to lie between air-fuel transfer conduit 40 and heat-transfer tube 12. Tip 42T is positioned to lie between root 42R and heat-transfer tube 12. As an example, root 42R is arranged to lie in spaced-apart relation to air-fuel transfer conduit 40 a relatively smaller second distance D2 as shown in FIG. 1. Second distance D2 allows detached first and second flame combustion products 71, 72 to be mixed into combustible air-fuel mixture 28 exiting second nozzle exit 32 prior to ignition of detached second flame 42. Detached second flame 42, like detached first flame 41, maintains combustion by extending out and onto interior surface 36 of heat-transfer tube 12 to stabilize on interior surface 36. As a result of root 42R being spaced-apart from second nozzle exit 32, the temperature of air-fuel transfer conduit 40 around second nozzle exit 32 is minimized further minimizing $NO_x$ formation from detached second flame 42.

Attached third flame 43 includes a root 43R and a tip 43T as shown in FIG. 1. Root 43R is arranged to lie on air-fuel discharge plate 44. Tip 43T is arranged to lie in spaced-apart relation to root 43R and extend in downstream direction 38. Attached third flame 43 is stabilized during combustion on air-fuel discharge plate 44 by any suitable means of attachment.

First and second nozzle exits 31, 32 are formed in air-fuel transfer conduit 40 so that detached first and second flame combustion products 71, 72 are mixed within combustible air-fuel mixture 28 flowing through first and second nozzle exits 31, 32. Flame combustion products 71, 72 are able to move within combustion chamber 30 as result of spacing between first and second nozzle exits 31, 32 being configured to block the merging of detached first and second flames 41, 42.

As an example, a distance d1 is defined between first nozzle exit 31 and second nozzle exit 32. Distance d1 is a function of a diameter d2 of air-fuel transfer conduit 40 as shown in FIG. 3. Illustratively, distance d1 is between about 1.8 and about 4.0 times diameter 84 of air-fuel transfer conduit 40. Distance d1 permits detached first flame 41 to ignite and stabilize on interior surface 36 of heat-transfer tube 12 while permitting detached second flame 42 to ignite and stabilize on interior surface 36. Distance d1 also operates to block detached first and second flames 41, 42 from merging together to form one flame and to maximize mixing of combustion products 71, 72 into detached first and second flames 41, 42.

As shown in FIG. 3, each of air-fuel discharge slots 52*a*, 52*b*, 52*c*, 52*d*, 52*e*, and 52*f* is configured to have a first width W1 defined between generally parallel sides 87, 89 of air-fuel discharge slots 52*a*, 52*b*, 52*c*, 52*d*, 52*e*, and 52*f*. Each of air-fuel discharge port 56*a*, 56*b*, 56*c*, 56*d*, 56*e*, and 56*f* is configured to have a relatively larger second width W2 defined between arcuate sides 91, 92 of air-fuel discharge ports 56*a*, 56*b*, 56*c*, 56*d*, 56*e*, and 56*f* as shown in FIG. 3. First width W1 is configured to be relatively smaller than second width W2 so that the appropriate volumetric flow of combustible air-fuel mixture 28 is communicated through associated nozzle exits 31, 32.

Air-fuel nozzle 16 of air-fuel burner 10 is shown in a high-fire state in FIG. 4 and in a low-fire state in FIG. 5. The high-fire state of air-fuel burner 10 is associated with maximized volumetric flow of combustible air-fuel mixture 28 through air-fuel transfer conduit 40 to maximize heat production and as a consequence heat transfer through heat-transfer tube 12. The low-fire state of air-fuel burner 10 is associated with a volumetric flow that is lower than the maximized volumetric flow of combustible air-fuel mixture 28. The low-fire state is used, as an example, during start-up of air-fuel burner 10 to warm the system and minimize thermal shock. After warming is complete, high-fire state may be used or another volumetric flow amount that is between high-fire state and low-fire state depending on the amount of heat needed to be transferred from heat-transfer tube 12 to adjacent medium 13.

As shown in FIG. 4, air-fuel nozzle 16 is shown when air-fuel burner 10 is in the high-fire state. Each of the second flame portions 58*a*, 58*b*, 58*c*, 58*d*, 58*e*, and 58*f* extend from second nozzle exit 32 in radially outward directions 34 to stabilize on interior surface 36. Illustratively, root 42R of detached second flame 42 is positioned to lie in spaced-apart relation to air-fuel transfer conduit 40 second distance D2 as shown in FIG. 4. During low-fire state, root 42R of detached second flame 42 is positioned to lie in spaced-apart relation to air-fuel transfer conduit 40 a relatively larger third distance D3 as shown in FIG. 5 as a result of the lower volumetric flow of combustible air-fuel mixture 28.

Flames 41, 42, 43 are arranged to have varying flame temperatures relative one another to minimize $NO_x$ formation in flames 41, 42, 43. Detached first flame 41 is configured to have a first flame temperature. Detached second flame 42 is configured to have a relatively larger second flame temperature relative to detached first flame 41. Attached third flame 43 is configured to have a relatively larger third flame temperature relative to detached first and second flames 41, 42. First and second flame temperatures are lower than third flame temperature as a result of detached first and second flames 41, 42 quenching on interior surface 36 of heat-transfer tube 12, detachment from air-fuel transfer conduit 40, and mixing of combined combustion products 74 into combustible air-fuel mixture 28 coming out of first and second nozzle exits 31, 32.

Figure 6:
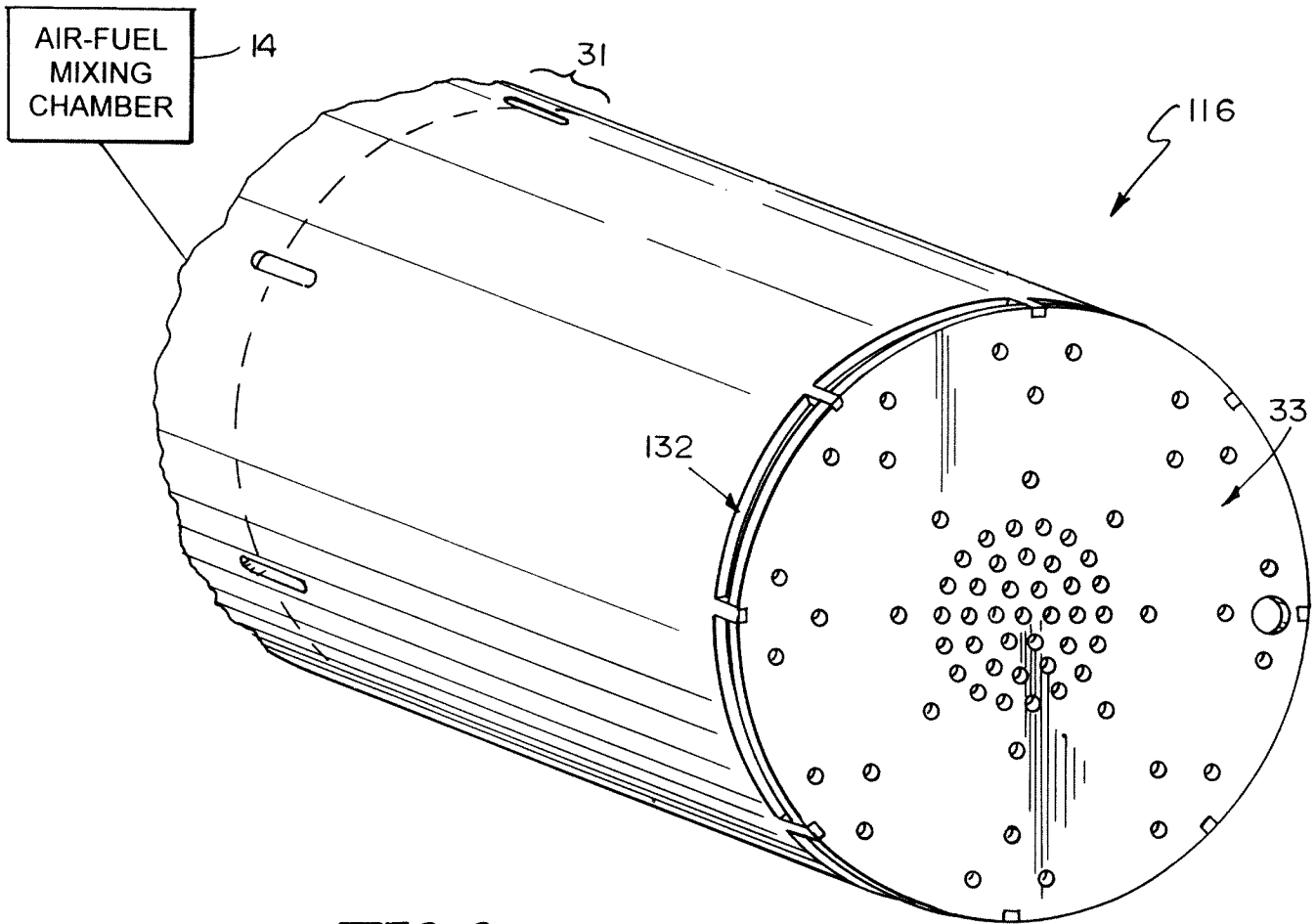
FIG. 6 is a partial perspective view of another embodiment of an air-fuel nozzle in accordance with the present disclosure, showing that the air-fuel nozzle includes an air-fuel transfer conduit coupled to the air-fuel mixing chamber and that the air-fuel transfer conduit is formed to include a set of air-fuel discharge slots spaced-apart around the circumference of the air-fuel conduit to establish a first nozzle exit associated with a first detached flame and an air-fuel discharge plate coupled to a downstream end of the air-fuel conduit to define a set of eight air-fuel discharge ports spaced-apart around the circumference of the air-fuel conduit to establish a second nozzle exit associated with a detached second flame and showing that the air-fuel discharge plate is formed to include as set of staged air-fuel discharge apertures opening in the downstream direction to establish a third flame.

As shown in FIG. 6, another embodiment of an air-fuel nozzle 116 is formed to include a first nozzle exit 31, a second nozzle exit 132, and third nozzle exit 33. As an example, second nozzle exit 132 is defined by a series of eight air-fuel discharge ports 156 positioned to lie in circumferentially spaced-apart relation to one another equally around a circumference 154 of an air-fuel transfer conduit 140 included in air-fuel nozzle 116. Each of air-fuel discharge port 156*a*, 156*b*, 156*c*, 156*d*, 156*e*, 156*f*, 156*g*, and 156*h* is defined by a downstream end 150 of air-fuel transfer conduit 140, a set of eight discharge-plate spacers 146 interconnecting air-fuel transfer conduit 140, and air-fuel discharge plate 44.

Air-fuel burner 10, as shown in FIG. 1, may be used in a boiler, a fire-tube heater, a hot-water heater, a liquid-solution heater, or any other suitable device. Illustratively, air-fuel burner 10 may be also be retrofitted onto an existing device to replace a less efficient air-fuel burner or a higher $NO_x$ producing burner.

Heat-transfer tube 12 includes an interior surface 36 and an exterior surface 80 arranged to lie in spaced-apart relation to interior surface 36 as shown in FIG. 2. Detached first and second flames 41, 42 stabilize on interior surface 36 during combustion. The temperature of heat-transfer tube 12 in regions where detached first and second flames 41, 42 stabilize is minimized by an adjacent medium 13 in contact with exterior surface 80 as shown in FIG. 1. Adjacent medium 13, illustratively water, absorbs the heat to cause $NO_x$ formation from detached first and second flames 41, 42 to be further minimized. In other embodiments, adjacent medium 13 is glycol, a glycol-water mixture, or any other suitable alternative.

Figure 7:
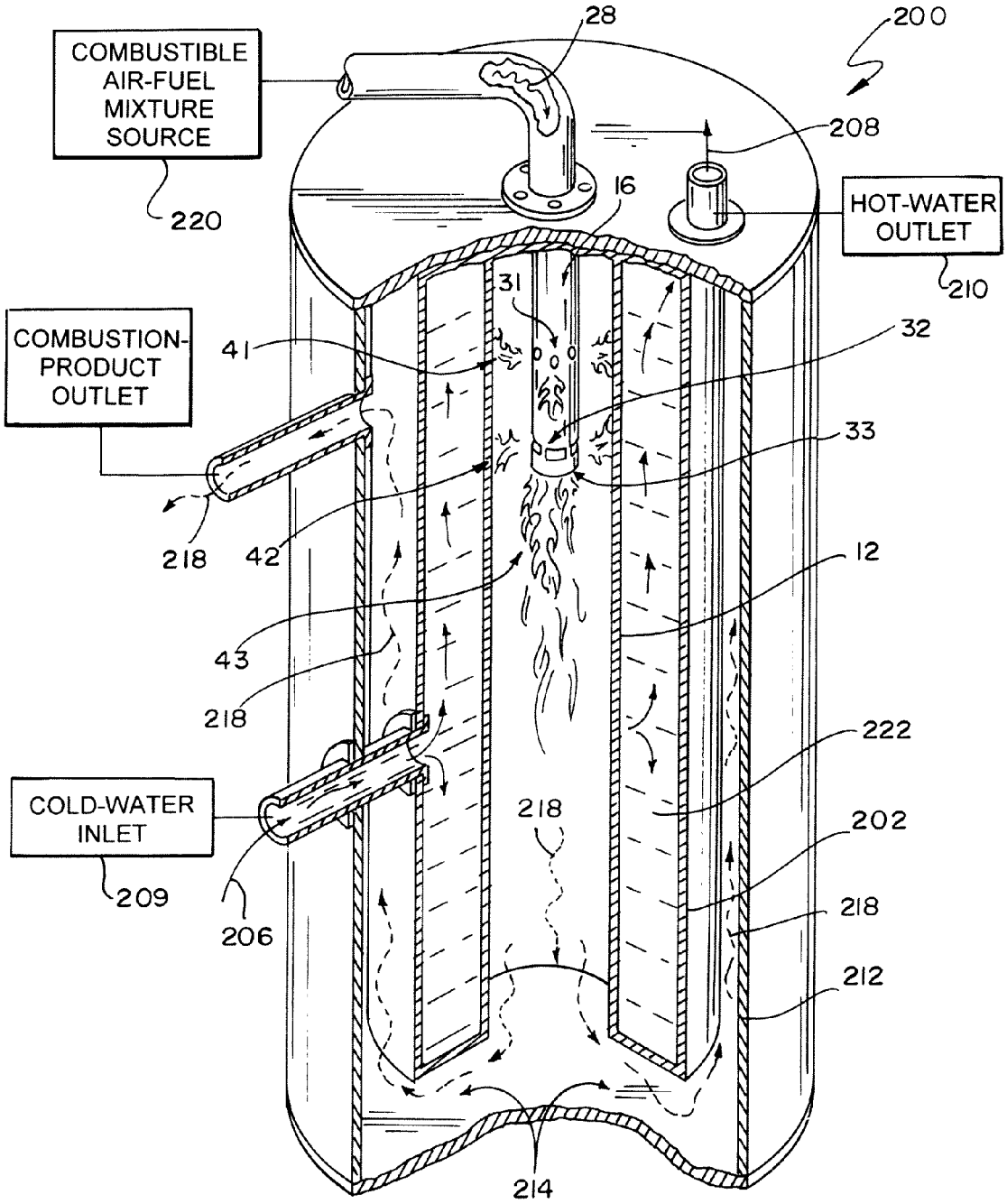
FIG. 7 is a partial perspective view showing a water heater including an air-fuel nozzle coupled in fluid communication to a source of a combustible air-fuel mixture and showing that the air-fuel nozzle is arranged to lie within an interior region of a heat-transfer tube to produce three flames that generate heat which heats the heat-transfer tube and transfers from the heat-transfer tube into water flowing through a water-heating chamber formed between a water vessel and the heat-transfer tube so that a temperature of water adjacent to the heat-transfer tube is raised.

As shown in FIG. 7, an illustrative water heater 200 includes air-fuel nozzle 16, heat-transfer tube 12, and a water vessel 202. Water vessel 202 is coupled to heat-transfer tube 12 to define a water-heating cavity 204 therebetween. Illustratively, cold water 206 flows into water-heating cavity 204 through a cold-water inlet 208 and hot water 208 flows out of water-heating cavity 204 through a hot-water outlet 210 as suggested in FIG. 7. Illustratively, water heater 200 further includes a water-heater shell 212 configured to enclose water vessel 202, heat-transfer tube 12, and air-fuel nozzle 16. Water-heater shell 212 cooperates with water vessel 202 and heat-transfer tube 12 to define a combustion-products passageway 214 therebetween. Illustratively, a combustion-product outlet 216 is formed in water-heater shell 212 to allow combined combustion products 218 to escape water heater 200 as suggested in FIG. 7.

Water heater 200 further includes a combustible air-fuel mixture source 220 which is coupled in fluid communication to air-fuel nozzle 16 to provide combustible air-fuel mixture 28 to air-fuel nozzle 16. As discussed previously, combustible air-fuel mixture 28 flows through first, second, and third nozzle exits 31, 32, 33 formed in air-fuel nozzle to form detached first and second flames 41, 42 and attached flame 41 when ignited. As shown in FIG. 7, detached first and second flames 41, 42 from air-fuel nozzle 16 toward heat-transfer tube 12 to stabilize thereon. Illustratively, water 222 within water vessel 202 operates to cool heat-transfer tube 12 to aid in minimizing NOX formation associated with first, second, and third flames 41, 42, 43.

Air-fuel burner 10 is configured to provide minimized $NO_x$ emissions and maximized efficiency in indirect fired applications such as boilers and fire-tube heaters. $NO_x$ is controlled in air-fuel burner 10 in accordance with the present disclosure by positioning first, second, and third flames 41, 42, 43, recirculation combined combustion products 74 into first and second flames 41, 42, flame stabilization on heat-transfer tube 12, and cooling of interior surface 36 of heat-transfer tube 12 by adjacent medium 13.

During operation of air-fuel burner 10, attached third flame 43, ignited originally with igniter 76 operates as an ignition sources for detached second flame 42. Attached third flame 43 has a small (about 10% to about 20%) volumetric fraction of combustible air-fuel mixture 28 emitted from air-fuel nozzle 16. Attached third flame 43 is stabilized, for example, on air-fuel discharge plate 44. It is within the scope of this disclosure to stabilize third flame 42 in any suitable manner. Detached second flame 42 which has a relatively larger (about 40% to about 80%) volumetric fraction of combustible air-fuel mixture 28 emitted from air-fuel nozzle 16. Detached second flame 42 is suspended around air-fuel discharge plate 44 and propagates freely between air-fuel discharge plate 44 and interior surface 36 of heat-transfer tube 12. As an example, detached first flame 41 has a relatively smaller (about 10% to about 20%) volumetric fraction of combustible air-fuel mixture 28 exiting through first nozzle exit 31 that mixes with second flame combustion products 72 to the point where first flame 41 is not self sustaining and burns as flameless combustion which is relatively transparent.

Illustratively, neither detached first flame 41 nor detached second flame 42 have any attachment mechanisms as a result of the exit velocity of combustible air-fuel mixture 28 exiting through associated first and second nozzle exits 31, 32 being higher than the flame propagation speed. Minimizing flame attachment points causes flame retention hot spots and eddy dwell time to be minimized. Detached first flame 41 is spaced-apart from detached second flame 42 so that detached first flame 41 forms its own independent flame separate from detached second flame 42. Detached first flame 41 operates to produce first flame combustion products 71 which move in downstream direction 38 to mix into detached second flame 42. Detached second flame 42 has no retention mechanism and propagates freely between air-fuel transfer conduit 40 and interior surface 36 of heat-transfer tube 12.

First and second flames 41, 42 are illustratively configured to be smooth and have a laminar flow. Turbulent flow of combustible air-fuel mixture 28 should be minimized when exiting first and second nozzle exits 31, 32 so that flame lift-off is promoted. As an example, first and second flames 41, 42 are configured to be non-symmetrical or uneven when viewed about the line 4-4 of FIG. 1. The imbalance in first and second flames 41, 42 encourages a self-induced internal recirculation of combined combustion products 74 from first and second flames 41, 42 into first and second flames 41, 42.

As shown in FIGS. 1 and 2, air-fuel mixing chamber 14 operates to provide a homogeneous mixture of air 20 and fuel 24 to establish combustible air-fuel mixture 28. Within air-fuel mixing chamber 14, air 20 and fuel 24 are converted into turbulent flows which promote efficient mixing to form a turbulent flow of combustible air-fuel mixture 28 into air-fuel transfer passageway 39 formed in air-fuel transfer conduit 40. Air-fuel transfer conduit 40 is configured to have a length sufficient to allow the turbulent flow of combustible air-fuel mixture 28 to return to a laminar flow within air-fuel transfer conduit 40. Laminar flow within air-fuel transfer conduit 40 allows for laminar flow out of first, second, and third nozzle exits 31, 32, 33 to occur.

Illustratively, air-fuel burner 10 is configured to provide less than about 10 ppm of $NO_x$ when using about 15% to about 30% excess air. Air-fuel burner 10, as an example, may use about 30% excess air or less without the use of any external combustion product recirculation. In addition, air-fuel burner 10 may operate between about 2% and about 8% Oxygen ($O_2$) and achieve about a 6 to 1 emission and thermal turndown ratio.

The invention claimed is:

1. An air-fuel burner comprising a heat-transfer tube formed to include an interior region and adapted to discharge heat to an adjacent medium located outside the heat-transfer tube when exposed to heat from a flame generated in the interior region, an air-fuel mixing chamber adapted to mix air from an air supply and fuel from a fuel supply to establish a combustible air-fuel mixture therein, and an air-fuel nozzle coupled to the air-fuel mixing chamber and arranged to extend into the interior region of the heat-transfer tube, the air-fuel nozzle being configured to provide means for forming three nozzle exits communicating with a combustion chamber defined in the interior region and located between the air-fuel nozzle and the heat-transfer tube to cause the combustible air-fuel mixture to exit from the air-fuel nozzle into the combustion chamber through a first nozzle exit formed in the air-fuel nozzle to establish, when a portion of the combustible air-fuel mixture flowing through the first nozzle exit is ignited, a detached first flame extending in radially outward directions in the combustion chamber from the air-fuel nozzle toward the heat-transfer tube, and the detached first flame includes a root positioned to lie between the air-fuel nozzle and the heat-transfer tube and a tip arranged to stabilize on an interior surface of the heat-transfer tube, a second nozzle exit formed in the air-fuel nozzle and arranged to lie in spaced-apart relation to the first nozzle exit in a downstream direction away from the air-fuel mixing chamber to establish, when a portion of the combustible air-fuel mixture flowing through the second nozzle exit is ignited, a detached second flame extending in radially outward directions in the combustion chamber from the air-fuel nozzle toward the interior surface of the heat-transfer tube, and the detached second flame includes a root positioned to lie between the air-fuel nozzle and the heat-transfer tube and a tip arranged to stabilize on the interior surface of the heat-transfer tube, and a third nozzle exit formed in the air-fuel nozzle and arranged to lie in spaced-apart relation to the second nozzle exit in the downstream direction to locate the second nozzle exit between the first and third nozzle exits and to establish, when a portion of the combustible air-fuel mixture flowing through the third nozzle exit is ignited, an attached third flame extending in the downstream direction away from the air-fuel nozzle and the detached first and second flames, and the attached third flame includes a root stabilized on the air-fuel nozzle and a tip extending in the downstream direction.

2. The air-fuel burner of claim 1, further comprising spacer means for separating the detached second flame produced from the second nozzle exit into a series of circumferentially spaced-apart second flame portions, each pair of adjacent second flame portions cooperating to define therebetween a combustion-products corridor configured to provide means for communicating combustion products of the detached first and second flames away from the air-fuel mixing chamber in the downstream direction through an upstream region in the combustion chamber inhabited by the detached second flame and into a downstream region in the combustion chamber inhabited by the attached third flame.

3. The air-fuel burner of claim 2, wherein the air-fuel nozzle includes an air-fuel transfer conduit and an air-fuel discharge plate, the air-fuel transfer conduit has an upstream end and a downstream end arranged to lie in spaced-apart relation opposite the upstream end and the air-fuel transfer conduit is coupled to the air-fuel mixing chamber at the upstream end and to the air-fuel discharge plate at the downstream end.

4. The air-fuel burner of claim 3, wherein the spacer means includes a set of discharge-plate spacers arranged to interconnect the air-fuel discharge plate and the air-fuel transfer conduit and each pair of adjacent discharge-plate spacers cooperate with the downstream end of the air-fuel transfer conduit and the air-fuel discharge plate to define each air-fuel discharge port and to separate each pair of second flame portions to establish each combustion-products corridor.

5. The air-fuel burner of claim 3, wherein the first nozzle exit is defined by a series of air-fuel discharge slots formed in the air-fuel transfer conduit and arranged to lie in circumferentially spaced-apart relation to one another around a circumference of the air-fuel transfer conduit.

6. The air-fuel burner of claim 5, wherein the second nozzle exit is defined by a series of air-fuel discharge ports formed in the air-fuel transfer conduit and arranged to lie in circumferentially spaced-apart relation to one another around the circumference of the air-fuel transfer conduit.

7. The air-fuel burner of claim 6, wherein the third nozzle exit is defined by a series of staged air-fuel discharge apertures formed in the air-fuel discharge plate and arranged to extend in a pattern between a center of the air-fuel discharge plate and a perimeter edge of the air-fuel discharge plate to cause the attached third flame, when ignited, to extend between the center and the perimeter edge to maintain ignition of the detached second flame.

8. The air-fuel burner of claim 6, wherein the air-fuel nozzle further includes a set of discharge-plate spacers arranged to interconnect the air-fuel discharge plate and the air-fuel transfer conduit and each pair of adjacent discharge-plate spacers, the downstream end of the air-fuel transfer conduit, and the air-fuel discharge plate cooperate to define each air-fuel discharge port included in the second nozzle exit.

9. The air-fuel burner of claim 1, wherein the first nozzle exit is configured to provide means for communicating about 10% to about 20% of the combustible air-fuel mixture, the second nozzle exit is configured to provide means for communicating about 40% to about 80% of the combustible air-fuel mixture, and the third nozzle exit is configured to provide means for communicating about 10% to about 20% of the combustible air-fuel mixture by volume through the air-fuel nozzle.

10. The air-fuel burner of claim 1, wherein a distance d1 between the first nozzle exit and the second nozzle exit is between about 1.8 and about 4 times a diameter d2 of the air-fuel nozzle.

11. The air-fuel burner of claim 1, wherein the root of the detached first flame is positioned to lie in spaced-apart relation to the air-fuel nozzle a first distance D1 and the root of the detached second flame is positioned to lie in spaced-apart relation to the air-fuel nozzle a relatively smaller second distance D2.

12. The air-fuel burner of claim 1, wherein the air-fuel nozzle includes an air-fuel transfer conduit and an air-fuel discharge plate, the air-fuel transfer conduit has an upstream end and a downstream end arranged to lie in spaced-apart relation opposite to the upstream end and the air-fuel transfer conduit is coupled to the air-fuel mixing chamber at the upstream end and to the air-fuel discharge plate at the downstream end, and wherein the first nozzle exit is defined by a series of air-fuel discharge slots formed in the air-fuel transfer conduit and arranged to lie in circumferentially spaced-apart relation to one another around a circumference of the air-fuel transfer conduit, the second nozzle exit is defined by a series of air-fuel discharge ports formed in the air-fuel transfer conduit and arranged to lie in circumferentially spaced-apart relation to each other around the circumference of the air-fuel transfer conduit, and each air-fuel discharge slot is configured to have a first width W1 and each air-fuel discharge port is configured to have a relatively larger second width W2.

13. The air-fuel burner of claim 12, wherein the series of air-fuel discharge slots is defined by a first discharge slot, a second discharge slot, a third discharge slot, a fourth discharge slot, a fifth discharge slot, and a sixth discharge slot and each discharge slot is positioned to lie in spaced-apart relation equally to one another around the circumference of the air-fuel transfer conduit from one another.

14. The air-fuel burner of claim 13, wherein the series of air-fuel discharge ports is defined by a first discharge port, a second discharge port, a third discharge port, a fourth discharge port, a fifth discharge port, and a sixth discharge port and each discharge port is positioned to lie in spaced-apart relation equally to one another around the circumference of the air-fuel transfer conduit from one another.

15. The air-fuel burner of claim 12, wherein the series of air-fuel discharge ports is defined by a first discharge port, a second discharge port, a third discharge port, a fourth discharge port, a fifth discharge port, a sixth discharge port, a seventh discharge port, and an eighth discharge port and each discharge port is positioned to lie in spaced-apart relation equally to one another around the circumference of the air-fuel transfer conduit from one another.

16. An air-fuel burner comprising a heat-transfer tube formed to include an interior region, an air-fuel mixing chamber configured to establish a combustible air-fuel mixture therein, and an air-fuel nozzle coupled to the air-fuel mixing chamber and arranged to extend into the interior region of the heat-transfer tube, the air-fuel nozzle formed to include three nozzle exits communicating with a combustion chamber defined in the interior region between the air-fuel nozzle and the heat-transfer tube to move the combustible air-fuel mixture from the air-fuel nozzle into the combustion chamber through a first nozzle exit formed in the air-fuel nozzle to establish, when a portion of the combustible air-fuel mixture flowing through the first nozzle exit is ignited, a detached first flame extending in radially outward directions in the combustion chamber from the air-fuel nozzle toward the heat-transfer tube, and the detached first flame includes a root positioned to lie between the air-fuel nozzle and the heat-transfer tube and a tip arranged to stabilize on an interior surface of the heat-transfer tube, a second nozzle exit formed in the air-fuel nozzle and arranged to lie in spaced-apart relation to the first nozzle exit in a downstream direction away from the air-fuel mixing chamber to establish, when a portion of the combustible air-fuel mixture flowing the through the second nozzle exit is ignited, a detached second flame extending in radially outward directions in the combustion chamber from the air-fuel nozzle toward the interior surface of the heat-transfer tube, and the detached second flame includes a root positioned to lie between the air-fuel nozzle and the heat-transfer tube and a tip arranged to stabilize on the interior surface of the heat-transfer tube, and a third nozzle exit formed in the air-fuel nozzle and arranged to lie in spaced-apart relation to the second nozzle exit in the downstream direction to locate the second nozzle exit between the first and third nozzle exits and to establish, when a portion of the combustible air-fuel mixture flowing through the third nozzle exit is ignited, a attached third flame extending in the downstream direction away from the air-fuel nozzle and the detached first and second flames, and the attached third flame includes a root stabilized on the air-fuel nozzle and a tip extending in the downstream direction.

17. The air-fuel burner of claim 16, wherein the air-fuel nozzle includes an air-fuel transfer conduit and an air-fuel discharge plate, the air-fuel transfer conduit has an upstream end and a downstream end arranged to lie in spaced-apart relation opposite the upstream end and the air-fuel transfer conduit is coupled to the air-fuel mixing chamber at the upstream end and to the air-fuel discharge plate at the downstream end.

18. The air-fuel burner of claim 17, further comprising a series of discharge-plate spacers arranged to separate the detached second flame into a series of circumferentially spaced-apart second flame portions, each pair of adjacent second flame portions are formed by each discharge-plate spacer, and each discharge-plate spacer and each pair of adjacent second flame portions cooperate to define a combustion-products corridor configured to provide means for communicating combustion products of the detached first and second flames away from the air-fuel mixing chamber in the downstream direction through an upstream region in the combustion chamber inhabited by the detached second flame and into a downstream region in the combustion chamber inhabited by the attached third flame.

19. The air-fuel burner of claim 18, wherein the series of discharge-plate spacers is defined by a first-discharge plate spacer, a second discharge-plate spacer, a third discharge-plate spacer, a fourth discharge-plate spacer, a fifth discharge-plate spacer, and a sixth discharge-plate spacer and each discharge-plate space is positioned to lie in spaced-apart relation equally around a circumference of the air-fuel nozzle.

20. An air-fuel burner comprising a heat-transfer tube formed to include an interior region and adapted to discharge heat to an adjacent medium located outside the heat-transfer tube when exposed to heat from a flame generated in the interior region, an air-fuel mixing chamber adapted to mix air from an air supply and fuel from a fuel supply to establish a combustible air-fuel mixture therein, and an air-fuel nozzle coupled to the air-fuel mixing chamber and arranged to extend into the interior region of the heat-transfer tube in a downstream direction away from the air-fuel mixing chamber, the air-fuel nozzle including an air-fuel transfer conduit having an upstream end and a downstream end arranged to lie in spaced-apart relation opposite to the upstream end, the air-fuel transfer conduit being formed to include an air-fuel transfer passageway arranged to transport the combustible air-fuel mixture between the upstream end and the downstream end, and the air-fuel transfer conduit being coupled to the air-fuel mixing chamber at the upstream to cause the air-fuel transfer passageway to open into the air-fuel mixing chamber and the air-fuel transfer conduit is formed to include a first nozzle exit to establish, when a portion of the combustible air-fuel mixture is communicated from the air-fuel transfer passageway through the first nozzle exit is ignited, a detached first flame extending in radially outward directions from the air-fuel transfer conduit toward the heat-transfer tube, the detached first flame having a root positioned to lie in spaced-apart relation to the air-fuel transfer conduit between the air-fuel transfer conduit and the heat-transfer tube and a tip arranged to stabilize on an interior surface of the heat-transfer tube, an air-fuel discharge plate formed to include a third nozzle exit arranged to lie in spaced-apart relation to the first nozzle exit in the downstream direction to establish, when a portion of the combustible air-fuel mixture communicated from the air-fuel transfer passageway through the third nozzle exit is ignited, an attached third flame extending in the downstream direction away from the air-fuel transfer conduit and the detached first flame, and the attached third flame includes a root stabilized on the air-fuel discharge plate and a tip extending in the downstream direction, and a set of discharge-plate spacers arranged to interconnect the air-fuel discharge plate and the air-fuel transfer conduit, each pair of adjacent discharge-plate spacers cooperating with the air-fuel transfer conduit and the air-fuel discharge plate to define a second nozzle exit upstream of the third nozzle exit, the second nozzle exit is arranged to lie between the first nozzle exit and the third nozzle exit to establish, when a portion of the combustible air-fuel mixture communicated from the air-fuel transfer passageway through the second nozzle exit is ignited, a detached second flame extending in radially outward directions from the air-fuel nozzle toward the interior surface of the heat-transfer tube, and the set of discharge-plate spacers are arranged to partition the detached second flame produced from the second nozzle exit into a series of circumferentially spaced-apart second flame portions, each pair of adjacent second flame portions formed by each discharge-plate spacer cooperating to define therebetween a combustion-products corridor configured to provide means for communicating combustion products of the detached first and second flames away from the air-fuel mixing chamber in the downstream direction through an upstream region in the combustion chamber inhabited by the detached second flame and into a downstream region in the combustion chamber inhabited by the attached third flame.

21. An air-fuel burner comprising a heat-transfer tube formed to include an interior region and adapted to discharge heat to an adjacent medium located outside the heat-transfer tube when exposed to heat from a flame generated in the interior region and an air-fuel nozzle coupled to an upstream end of the heat-transfer tube and arranged to extend into the interior region of the heat-transfer tube, the air-fuel nozzle being configured to provide means for forming three nozzle exits communicating with a combustion chamber defined in the interior region and located between the air-fuel nozzle and the heat-transfer tube to cause a combustible air-fuel mixture to exit from the air-fuel nozzle into the combustion chamber through a first nozzle exit formed in the air-fuel nozzle to establish, when a portion of the combustible air-fuel mixture flowing through the first nozzle exit is ignited, a detached first flame extending in radially outward directions in the combustion chamber from the air-fuel nozzle toward the heat-transfer tube, and the detached first flame includes a root positioned to lie between the air-fuel nozzle and the heat-transfer tube and a tip arranged to stabilize on an interior surface of the heat-transfer tube, a second nozzle exit formed in the air-fuel nozzle and arranged to lie in spaced-apart relation to the first nozzle exit in a downstream direction away from the upstream end of the heat-transfer tube to establish, when a portion of the combustible air-fuel mixture flowing through the second nozzle exit is ignited, a detached second flame extending in radially outward directions in the combustion chamber from the air-fuel nozzle toward the interior surface of the heat-transfer tube, and the detached second flame includes a root positioned to lie between the air-fuel nozzle and the heat-transfer tube and a tip arranged to stabilize on the interior surface of the heat-transfer tube, and a third nozzle exit formed in the air-fuel nozzle and arranged to lie in spaced-apart relation to the second nozzle exit in the downstream direction to locate the second nozzle exit between the first and third nozzle exits and to establish, when a portion of the combustible air-fuel mixture flowing through the third nozzle exit is ignited, an attached third flame extending in the downstream direction away from the air-fuel nozzle and the detached first and second flames, and the attached third flame includes a root stabilized on the air-fuel nozzle and a tip extending in the downstream direction.

* * * * *